US005470267A

United States Patent [19]

Busam

[11] Patent Number: 5,470,267

[45] Date of Patent: Nov. 28, 1995

[54] SPARK PRODUCING MECHANISM

[75] Inventor: Edward P. Busam, Mason, Ohio

[73] Assignee: Hasbro, Inc., Pawtucket, R.I.

[21] Appl. No.: 386,849

[22] Filed: Feb. 10, 1995

[51] Int. Cl.[6] ..... A63H 33/36

[52] U.S. Cl. ..... 446/22; 446/145; 446/144

[58] Field of Search ..... 446/22, 23, 144, 446/145, 484; 40/427; 472/61, 66

[56] References Cited

U.S. PATENT DOCUMENTS

| | | | |
|---|---|---|---|
| 1,997,235 | 4/1935 | Schrodel . | |
| 2,198,177 | 4/1940 | Pohlhaus . | |
| 2,574,952 | 11/1951 | Berger | 446/23 |
| 3,052,060 | 9/1962 | Wohlstrom | 446/22 |
| 3,308,572 | 3/1967 | Tomarkin | 446/22 |
| 3,390,483 | 7/1968 | Doe | 446/145 |
| 3,468,732 | 9/1969 | Hewitt . | |
| 3,859,749 | 1/1975 | Morin et al. | 446/145 |
| 3,917,497 | 11/1975 | Stickler . | |
| 4,090,898 | 5/1978 | Tuskos . | |

FOREIGN PATENT DOCUMENTS

| | | | |
|---|---|---|---|
| 2109255 | 6/1983 | United Kingdom | 446/144 |

OTHER PUBLICATIONS

Playthings, vol. 62, #7, Jul. 1964, pp. 129–130.

*Primary Examiner*—Robert A. Hafer
*Assistant Examiner*—Jeffrey D. Carlson
*Attorney, Agent, or Firm*—Kurt R. Benson

[57] ABSTRACT

A spark producing mechanism for a toy includes an at least partially transparent housing, a rotatable abrasive element in the housing and a motor for rotating the abrasive element. The mechanism further includes at least one flint element which is loosely captured in the housing so that it can contact and carom off the abrasive element to randomly produce sparks in the housing during rotation of the abrasive element.

5 Claims, 2 Drawing Sheets

SPARK PRODUCING MECHANISM

BACKGROUND AND SUMMARY OF THE INVENTION

The instant invention relates to toys and more particularly to a mechanism for randomly producing sparks in a toy.

It has generally been found that toys which are capable of producing sparks frequently have high levels of appeal. Consequently, a variety of different types of spark producing mechanisms have been heretofore available for use in toys of different types. For the most part, the heretofore available spark producing mechanisms have comprised abrasive elements which contact flint elements for producing sparks during relative movement therebetween. However, virtually all of the heretofore available spark producing mechanisms of this type have included one or more rigidly mounted flint elements which produce sparks as they contact an abrasive surface during controlled movement of either the flint elements or the abrasive surface. Consequently, virtually all of the heretofore available sparking mechanisms have produced relatively controlled sparking effects. It has been found that sparking mechanisms of this type are generally less than entirely effective when they are used for simulating the types of random sparking actions associated with items, such as power tools and the like.

The instant invention provides a new sparking mechanism which is operative for randomly producing sparks so that it is capable of more closely simulating the types of random sparking actions associated with certain types of apparatus and machinery, including power tools. More specifically, the instant invention provides a spark producing mechanism comprising a rotatable abrasive element and at least one flint element which is operative for randomly contacting the abrasive element to randomly produce sparks. Still more specifically, the spark producing mechanism of the instant invention comprises a housing defining an enclosed interior area and including a transparent wall portion, and a rotatable abrasive element in the housing which cooperates with the housing for defining a confined or enclosed cavity therebetween. The spark producing mechanism further comprises at least one flint element which is loosely captured in the cavity between the housing and the abrasive element and means for rotating the abrasive element in the housing. Accordingly, during rotation of the abrasive element, the flint element is free to travel loosely in the cavity so that it can randomly contact and deflect off of the abrasive surface to randomly produce sparks in the cavity during rotation of the abrasive element. The abrasive element preferably comprises an axially rotatable circular disk having an abrasive primary face thereon which cooperates with the housing to define the enclosed cavity. The abrasive element preferably comprises a sandpaper disk which defines the primary face thereon, and the spark producing mechanism preferably comprises a plurality of flint elements which are loosely received in the cavity. The circular disk preferably also has a secondary face thereon, and the spark producing mechanism preferably further comprises a socket on the secondary face and a rotatable element comprising a simulated power tool component which is operative for randomly producing sparks during rotation thereof. Accordingly, the socket and the rotatable element are also rotated when the circular disk is rotated to simulate the rotation of a power tool component. Further, the sparks which are produced by the flint elements during rotation of the circular disk appear to be coming from the rotatable power tool component to more realistically simulate the operation of an actual power tool.

Accordingly, it is a primary object of the instant invention to provide an effective mechanism for randomly producing sparks in a toy.

Another object of the instant invention is to provide a sparking mechanism in which one or more flint elements randomly contact an abrasive surface to randomly produce sparks.

An even further object of the instant invention is to provide an effective sparking mechanism which can be utilized for producing sparks in a manner similar to that of an actual power tool, such as a welder.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
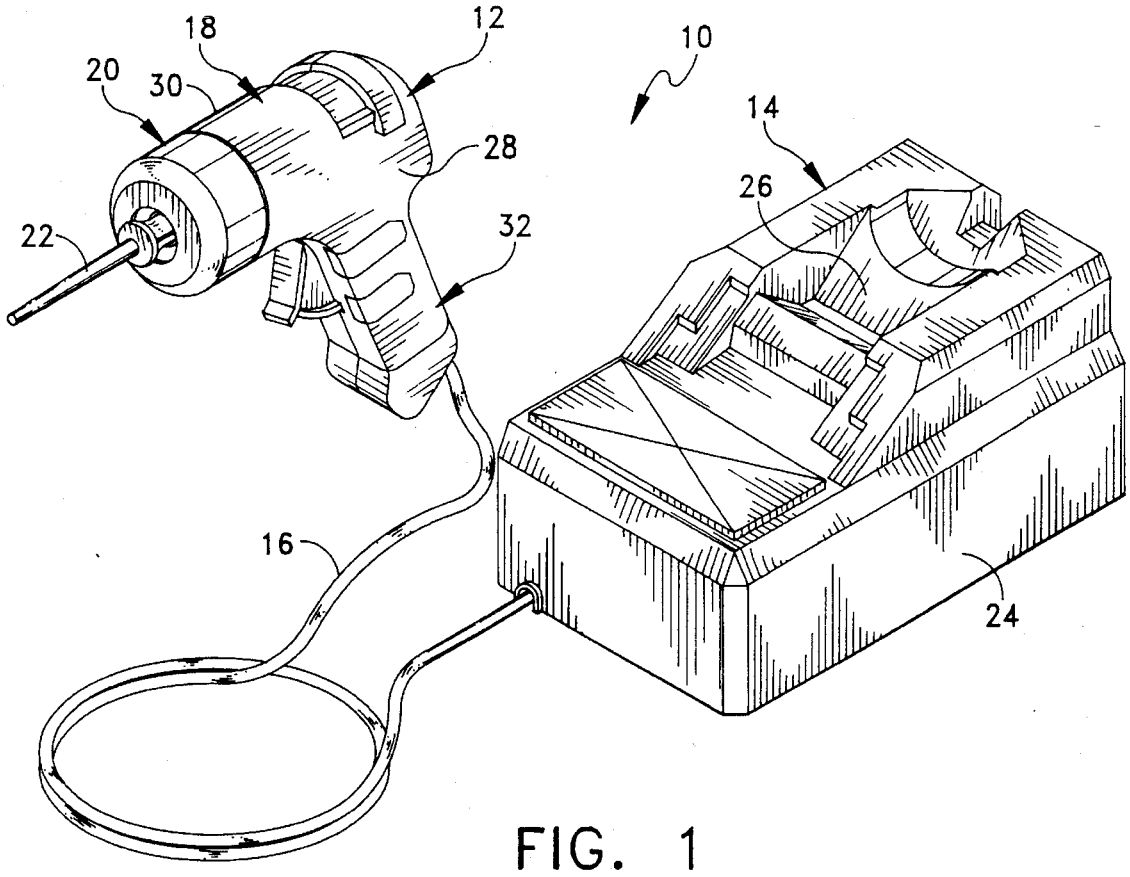
FIG. 1 is a perspective view of the spark producing mechanism of the instant invention as embodied in a toy welding apparatus.
Figure 2:
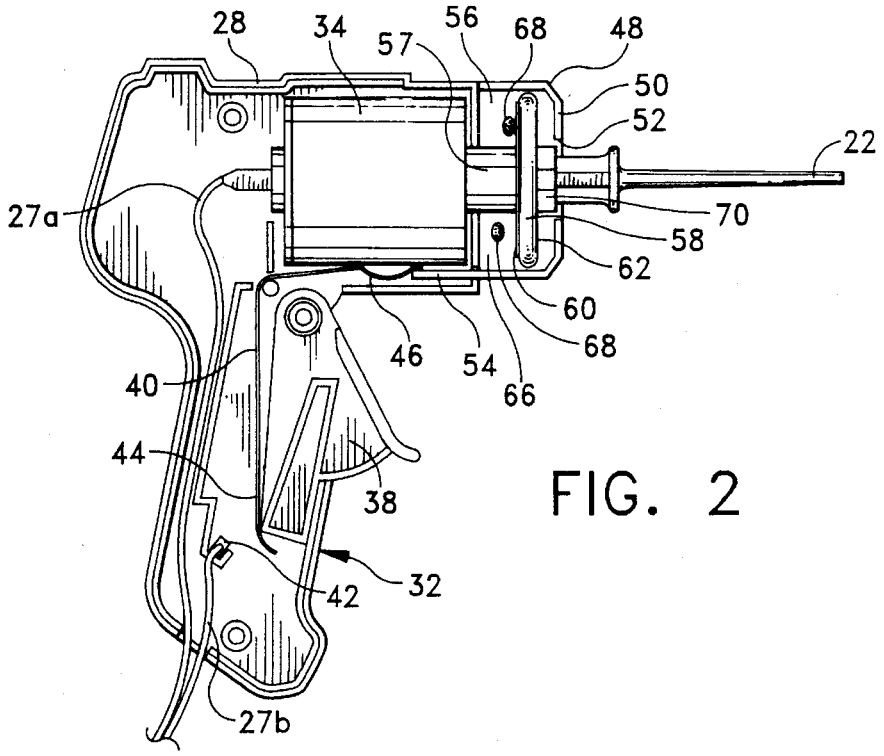
FIG. 2 is a side elevational view of the welding gun portion of the apparatus with one side of the housing removed.
Figure 3:
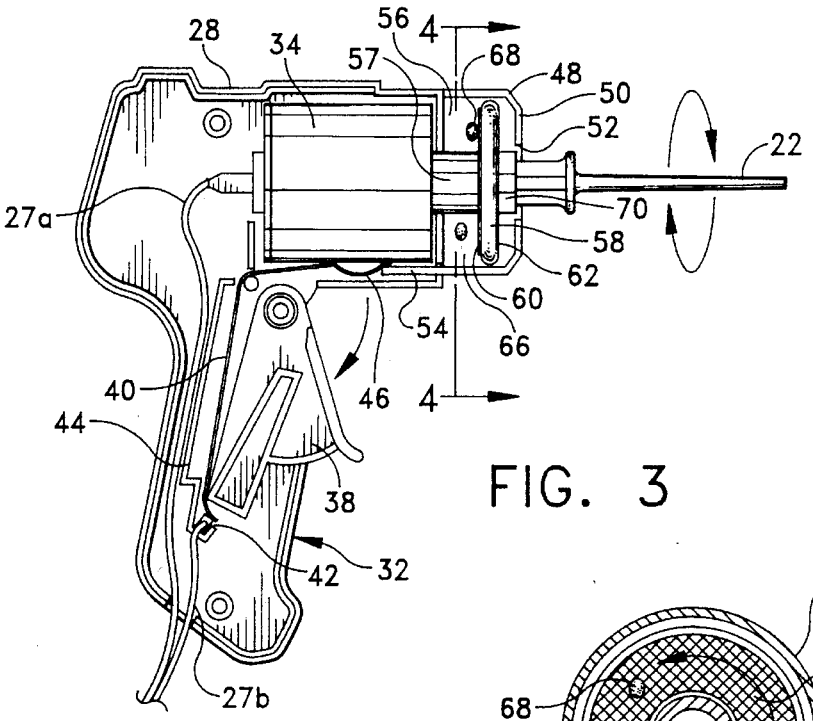
FIG. 3 is a similar view illustrating the welding gun portion in operation.
Figure 4:
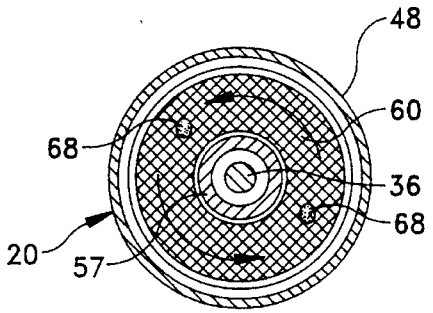
FIG. 4 is a sectional view taken along line 4—4 in FIG. 3.
Figure 5:
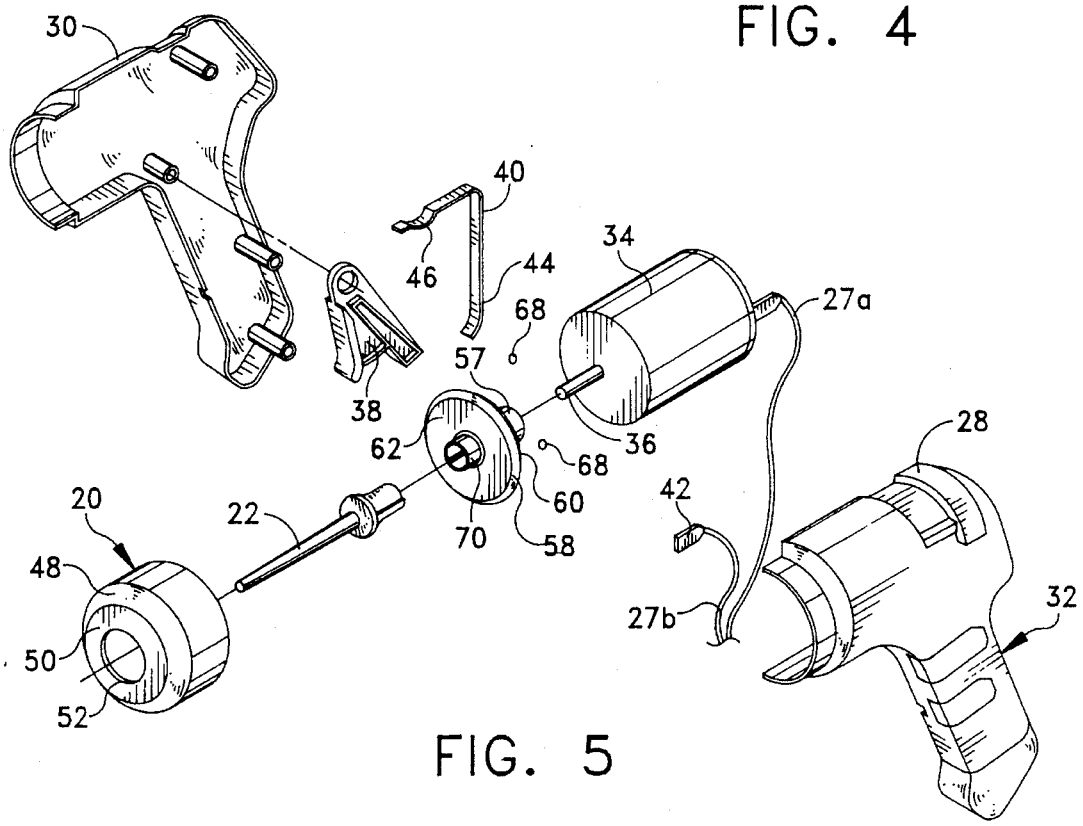
FIG. 5 is an exploded perspective view of the apparatus.

Referring now to the drawings, the spark welding apparatus of the instant invention is illustrated in FIGS. 1 through 5 and generally indicated at 10 in FIG. 1. The apparatus 10 comprises a welding gun generally indicated at 12, a base portion generally indicated at 14, and an electrical cable 16 which extends from the base portion 14 to the welding gun 12. The welding gun 12 comprises a drive portion generally indicated at 18, a sparking mechanism 20, and a spin welding rod 22. During operation of the apparatus 10, the welding gun 12 is operative for rotating the spin welding rod 22 in order to perform a spin welding operation in a conventional manner such as disclosed in co-pending application Ser. No. 08/323,333, and the sparking mechanism 20 is operative for randomly producing sparks adjacent to the welding rod 22. Accordingly, the operation of the welding gun 12 realistically simulates the operation of an actual arc welding apparatus in which sparks are randomly produced as a work piece is contacted by an arc welding rod.

The base portion 14 comprises a housing 24 which is adapted to simulate an actual base unit of an arc welding apparatus. The housing 24 includes a nest area 26 for receiving the welding gun 12 therein in a storage position. The base portion 14 is adapted for receiving a plurality of batteries (not shown) for powering the welding gun 12 so as to rotate the spin welding rod 22 during a spin welding operation.

The cable 16 comprises a conventional electrical cable which is adapted for transporting electrical current from the batteries in the base portion 14 to the drive portion 18 through electrical wires 27*a* and 27*b*.

The drive portion 18 comprises a housing including left and right housing sections 28 and 30, respectively, which cooperate to define a pistol-like housing having a hand grip portion 32. The drive unit 18 further comprises an electrical motor 34 which is received and secured in the housing defined by the left and right housing sections 28 and 30. The electrical motor 34 has a metal outer housing, and it includes a forwardly extending rotatable shaft 36 which extends into the spark producing mechanism 20 as will hereinafter be more fully set forth. Also included in the drive portion 18 is a pivotally mounted trigger element 38 and a biasing spring 40 which biases the trigger element 38 to a forwardly pivoted position. The first conductor wire 27*a* is connected directly to the motor 34, whereas the second conductor wire 27*b* terminates in a contact 42 which is secured in the housing section 28. The spring 40 includes a pivoting contact portion 44 and a motor contact portion 46. The motor contact portion 46 normally contacts the metal housing of the motor 34, and the pivoting contact portion 44 is constructed so that when the trigger element 38 is pivoted rearwardly, it is moved into engagement with the contact element 42 to electrically connect the second conductor wire 27*b* to the motor 34. As a result, when the trigger element 38 is moved rearwardly in the handle portion 32, the biasing spring 40 is eventually brought into engagement with the contact 42 to electrically energize the motor 34.

The spark producing mechanism 20 includes a cylindrical housing portion 48 which is received on the forward end portion of the drive portion 18. The housing portion 48 is preferably made from a transparent plastic material, and it includes a front wall 50 having a central opening 52 therein. The housing 48 also includes a tab 54 which engages the contact portion 46 of the spring 40 to maintain it in engagement with the housing of the motor 34. The housing 48 cooperates with the housing defined by the left and fight housing sections 28 and 30 to define a substantially enclosed interior area 56. The spark producing mechanism 20 further comprises a hub 57 which is received on the shaft 36 and an abrasive element 58 which is herein embodied in the form of a substantially flat circular disk having a primary face 60 and a secondary face 62. The primary face 60 defines an abrasive surface which is formed by a substantially circular sandpaper disk. The abrasive element 58 extends outwardly from the hub 57 so that the primary face 60 faces toward the motor 34. Further, the circular disk comprising the abrasive element 58 is just slightly smaller in diameter than the interior of the housing 48 so that the abrasive, element 58 and the housing 48 cooperate to form an enclosed rear cavity 66 which surrounds the hub 57. The spark producing mechanism 20 further comprises a pair of flint elements 68 which are loosely received in the cavity 66. However, because the perimeter of the abrasive element 58 is closely spaced from the wall of the housing 48, the flint elements 68 are captured in the enclosed rear cavity 66 in a manner which permits the flint elements 68 to loosely travel therein. Extending forwardly from the secondary face 62 of the sparking element 58 is a socket 70, and the spin welding element 22 is removably received in the socket 70 so that the spin welding element 22 rotates with the motor 34, the hub 57 and the abrasive element 58.

The welding rod 22 comprises a conventional thermoplastic spin welding rod which is adapted for performing a conventional spin welding operation of the type described in co-pending application No. 08/323,333 and the U.S. Pat. to Hewitt, No. 3,468,732.

Accordingly, for use and operation of the apparatus 10, the welding gun portion 12 is held in a hand of a user so that the user can conveniently operate the trigger element 38 in a conventional manner. When the trigger element 38 is pivoted rearwardly to energize the motor 34, the hub 57, the abrasive element 58, the socket 70, and the spin welding rod 22 are simultaneously rotated. As the abrasive element 58 is rotated, the flint elements 68 are free to travel loosely in the rear cavity 66 so that they occasionally contact the abrasive surface of the primary face 60 to produce sparks from the sparking mechanism 20. However, when the welding gun portion 12 is moved into a welding position in which the spin welding rod 22 extends in a generally downward direction, the flint elements 68 inherently gravitate onto the primary surface 60 so that they repeatedly contact the surface 60 during rotation of the abrasive element 58. Because the flint elements 68 inherently contact the abrasive element 58 in a random manner, sparks are randomly produced from the spark producing mechanism, and because the flint elements 68 inherently gravitate onto the primary surface 60 when the welding gun 12 is positioned so that the welding rod 22 extends downwardly, a greater quantity of sparks is produced from the spark producing mechanism 20 when the welding gun 12 is held in a normal operating position in which the welding rod 22 extends downwardly for contacting a work piece.

It is seen, therefore, that the instant invention provides an effective mechanism for randomly producing sparks in a toy. The sparking mechanism 20 is particularly effective for use in a toy spin welding apparatus, such as the apparatus 10, although it can also be effectively embodied in a variety of other configurations in toy products, such as other toy power tools. The spark producing mechanism 20 is capable of effectively randomly producing sparks to provide a more realistic sparking action as the flint elements 68 carom off the housing walls and the primary surface 60 in the enclosed rear cavity 66. Hence, the sparking mechanism 20 represents an effective new type of sparking mechanism which has wide application in the toy art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A spark producing mechanism comprising (a) a housing defining a substantially enclosed interior area, said housing including a transparent wail portion for viewing said interior area;

(b) an abrasive element in said housing having a rough abrasive surface thereon, said abrasive element being mounted in said housing and rotatable with respect to said housing for rotation about a predetermined axis and cooperating with said housing for defining an enclosed cavity therebetween;

(c) a flint element loosely captured in said cavity, said flint element being dimensioned to travel freely in said cavity such that said flint element can randomly contact and deflect off of said abrasive surface to randomly produce sparks during rotation of said abrasive element in said housing; and (d) means for rotating said abrasive element in said housing.

2. In the spark producing mechanism of claim 1, said abrasive element comprising an axially rotatable circular disk having an abrasive primary face thereon, said primary face defining said abrasive surface and cooperating with said housing to define said cavity.

3. In the spark producing mechanism of claim 2, said abrasive element comprising a sandpaper disk defining said primary face.

4. The spark producing mechanism of claim 1 further comprising a plurality of said flint elements loosely received in said cavity.

5. In the spark producing mechanism of claim 2, said circular disk also having a secondary face thereon, said spark producing mechanism further comprising a socket on said secondary face and a rotatable element in said socket, said rotatable element simulating a spark producing power tool component.

* * * * *